US005791127A

United States Patent [19]

Rossi

[11] Patent Number: 5,791,127

[45] Date of Patent: Aug. 11, 1998

[54] APPARATUS FOR THE MANUFACTURE OF GROUND COFFEE-POWDER BAGS

[75] Inventor: Giampiero Rossi, Rivanazzano, Italy

[73] Assignee: G. Rossi SRL, Pontecurone, Italy

[21] Appl. No.: 742,864

[22] Filed: Nov. 1, 1996

[30] Foreign Application Priority Data

Nov. 10, 1995 [IT] Italy ..... MI950777 U

[51] Int. Cl.[6] ..... B65B 1/04; B65B 37/06

[52] U.S. Cl. ..... 53/559; 53/202; 53/250; 53/258

[58] Field of Search ..... 53/559, 442, 471, 53/260, 258, 255, 251, 252, 250, 253, 202, 553

[56] References Cited

U.S. PATENT DOCUMENTS

| | | | |
|---|---|---|---|
| 2,072,568 | 3/1937 | Reinhardt | 53/253 |
| 3,311,140 | 3/1967 | Hughes | 141/144 |
| 3,778,965 | 12/1973 | O'Lenick et al. | 53/258 X |
| 4,831,811 | 5/1989 | Nixon, Jr. et al. | 53/202 X |
| 5,379,574 | 1/1995 | Fischer et al. | 53/202 X |
| 5,570,562 | 11/1996 | Anderson | 53/258 X |

FOREIGN PATENT DOCUMENTS

| | | |
|---|---|---|
| 0225494 | 6/1987 | European Pat. Off. . |
| 1337511 | 11/1973 | United Kingdom . |

*Primary Examiner*—James F. Coan

*Attorney, Agent, or Firm*—McAulay Fisher Nissen Goldberg & Kiel, LLP

[57] ABSTRACT

A device for supplying and metering freshly ground coffee powder in an apparatus for packaging bags of coffee powder in an apparatus for manufacturing bags of ground coffee-powder for packaging of bags of coffee powder comprising a device for supplying and metering freshly ground powder including a metering device, a distribution disc and a closing disc provided with through-holes which can be aligned in predetermined angular positions of the discs themselves, so as to supply one or more measures of coffee powder at a time into cavities formed in a link conveyor supporting a bottom strip of filter paper shaped so to have successive receiving cavities. The through-holes in the metering device and in the closing disc are two in number so as to make use of the fact that in general circles of the metering device and closing disc intersect each other always at two separate points.

20 Claims, 3 Drawing Sheets

200
204
202
208A
210
222
206A
248
212
208B
206B
238
216B
220
250
216A
232A
214
218
236
226
240
232B
250A
234
246
224
230
250B
228B
228A
12
244
10

APPARATUS FOR THE MANUFACTURE OF GROUND COFFEE-POWDER BAGS

BACKGROUND OF THE INVENTION

FIELD OF THE INVENTION

The present invention relates to so-called coffee-bag making machines, namely machines intended for the manufacture of bags containing coffee powder.

DESCRIPTION OF THE PRIOR ART

It is well known that in recent years a technology for the preparation of espresso coffee and coffee infusions has been developed, being based on the use of so-called bags or tablets comprising a measured and precompressed quantity of freshly ground coffee powder and a filter paper wrapping. These bags are preserved in wrappings which are impervious not only to water but also, and in particular, to the oxygen in the air, which is the main factor responsible for ageing and organoleptic deterioration of the coffee powder, being the impervious wrapping preferably filled with nitrogen or some other inert gas.

Apart from the preservation methods, an important problem is that of the industrial production of these bags or tablets, since numerically large quantities (of the order of tens of thousands per day must obviously be produced. Preferably the industrial production involves the manufacture of fairly long strips of bags which are joined together alone one edge where a weakening line is formed, for example by means of micro perforation, so as to be able to separate by means of tearing a single bag from the strip at the time of use.

Obviously it is also possible for the strips of bags to be divided up so that the individual bags may be kept detached from one another.

A machine useful for such a manufacturing method is for example that described and illustrated in British Patent No. 1,011,872, said machine comprising substantially a translating surface on which there is placed a strip of filter paper (bottom strip) having, at regular intervals, cavities of a shape and size suitable for receiving a predetermined measure of freshly ground coffee powder.

The measure of coffee powder deposited in the cavities is then compressed and a top covering strip, also consisting of filter paper, is then placed over the said strip, after which the two overlapping strips are bonded together along the entire periphery of each measure or tablet of fresh coffee powder, for example by means of heat-sealing. More specifically, the bottom strip of filter paper cooperates with a chain of plates movable along the support surface and forming a closed ring, each plate being provided with an upper surface having formed in it cavities with the same shape as the cavity which is to be provided in the strip of filter paper prior to depositing therein the required measured quantity of freshly ground coffee powder.

The strip of paper is unwound from a supply reel and covers the aforementioned upper surface of the plates, after which each plate passes through a plurality of stations inside which suitable operating components perform the sequence of operations briefly described above.

Therefore, after the station where the bottom strip of filter paper is deposited, there is located in succession:

- a station for forming the cavity in the bottom strip of filter paper;
- a station for supplying a measure of coffee powder;

- a station for pressing the measure of coffee powder already present in the cavity, so that the upper surface of the plate located underneath the bottom strip of filter paper acts as a support or counter-surface;
- a station for unwinding and depositing a top covering strip of filter paper;
- a station for heat-sealing the two strips of filter paper along the entire perimeter of the compressed coffee powder.

Moreover, suction means operate along the path of the plates, said means having substantially the function of retaining the bottom strip of filter paper and removing any coffee powder which during deposition and/or pressing escapes from the edges of the tablet.

Obviously, the aforementioned stations must be operated in synchronism, which poses significant problems not only as regards the mechanical structure of the machine, but also in terms of the maintenance requirements and frequency of repair, to the detriment, therefore, of the productivity.

The European Patent No. 0,225,494 describes an apparatus for packaging the said bags or tablets, which comprises a fixed support surface on which a plurality of flat cup-shaped devices intermittently advances, each of said devices being formed by a substantially quadrangular plate having a central recess with rounded edges, the bottom of said recess being in communication, via a plurality of holes, with openings formed in the aforementioned support surface, said openings in turn communicating with a vacuum source, the apparatus comprising two operating stations, the first of which forms a corresponding cavity in the bottom strip of paper deposited on the aforementioned recess, fills it with a measure of coffee powder supplied by a suitable metering device and compacts and presses said powder, while in the second station heat-sealing of the top strip of paper onto the bottom strip containing the pressed measure of coffee powder is performed.

This apparatus is characterized in particular by the fact that the cavity formed in the bottom strip of paper is kept in the desired shape owing to the vacuum applied underneath the strip itself through the holes formed in the bottom of the cavity to which the aforementioned bottom strip of filter paper is made to adhere during forming.

Another feature which characterizes this apparatus consists in the configuration of the device for metering and supplying the predetermined measure of coffee powder into the preformed cavity of the bottom strip of paper, for which reference should be made to the detailed description and the drawings.

As already mentioned, these types of apparatus must have a very high production rate, so that any improvement which increases this productivity and/or simplifies the machine from a structural point of view and/or reduces the probability of faults or malfunctions is of great importance from an industrial point of view.

SUMMARY OF THE INVENTION

It has now been discovered—this constituting the subject of the present invention—that it is possible to improve the apparatus with regard to metering of the ground coffee powder, an improvement which concerns both the number of bags which may be manufactured for each production cycle of the apparatus and the mechanical components of the metering device.

The principle of the present invention is based essentially on the fact that each straight line or circle intersecting a circle meets it at two separate points and this principle therefore allows the metering and simultaneous delivery of at least two measures of coffee powder.

The present invention therefore relates to an apparatus for the manufacture of bags of ground coffee powder, of the type described and illustrated in European Patent No. 0,225,494, characterized in that it comprises:

one or more fixed metering containers having a bottom provided with a pair of through-holes of diameter corresponding to the volumetric quantity of coffee powder to be supplied onto the bottom strip or strips of paper so as to form one or more measures for a bag;

a first distribution disc, rotating intermittently and provided with a plurality of pairs of holes spaced angularly so that for each angular rotating movement a pair of holes is arranged in vertical alignment with the pair of holes in the bottom of said metering containers;

one or more intermittently rotating discs, each provided with a pair of through-holes spaced so that in one of the positions assumed by the disc during its intermittent rotation said pair of holes is aligned with one of said pairs of holes in said distribution disc;

a fixed plate having one or more pairs of holes in vertical alignment with the pair of holes in said closing discs when said latter pair is aligned with a pair of holes in said distribution disc and drive means consisting of a single motor operating a single drive shaft which operates said distribution disc;

gearing means for transmitting in a synchronized manner the movement from said distribution disc to said closing disc, said drive shaft having rigidly connected to it a mechanical intermittent device for controlling the intermittent angular movements of the corresponding distribution disc, a second intermittent device being rigidly connected to the feed chain having cavities for receiving individual doses of ground coffee powder so that, for each advancing movement of the chain, two of said cavities are arranged in a position suitable for receiving simultaneously individual doses of coffee powder.

It should be remembered also that, if a disc is rotated, the stresses for causing rotation of this disc are reduced by an amount corresponding to the reduction in the angle of rotation of the latter. Consequently, if the number of pairs of holes on the distribution disc is increased, the latter is forced to rotate covering smaller angles and hence reducing the stresses on the said disc.

For example, with four pairs of holes, the distribution disc must rotate covering angles of 90°, with eight pairs it rotates through 45°, with 12 pairs it rotates through 30°, etc., so that it is convenient to increase the number of pairs of holes.

Finally, it is possible to multiply further the speed of an apparatus according to the present invention, arranging several fixed metering containers above the first distribution disc and several closing discs, alternately with the metering containers, provided that the number of metering containers is equal to the number of stopping discs. This fact causes a reduction in the speed of rotation of the metering disc and, at the same time, increases the production speed.

BRIEF DESCRIPTION OF THE DRAWINGS

The specific characteristic features and advantages of the present invention will appear more clearly from the following description of a preferred embodiment of the invention, provided with reference to the accompanying figures, in which.

In the description which follows, where possible, use will be made of the same reference numbers as those in the European Patent referred to.

Figure 1:
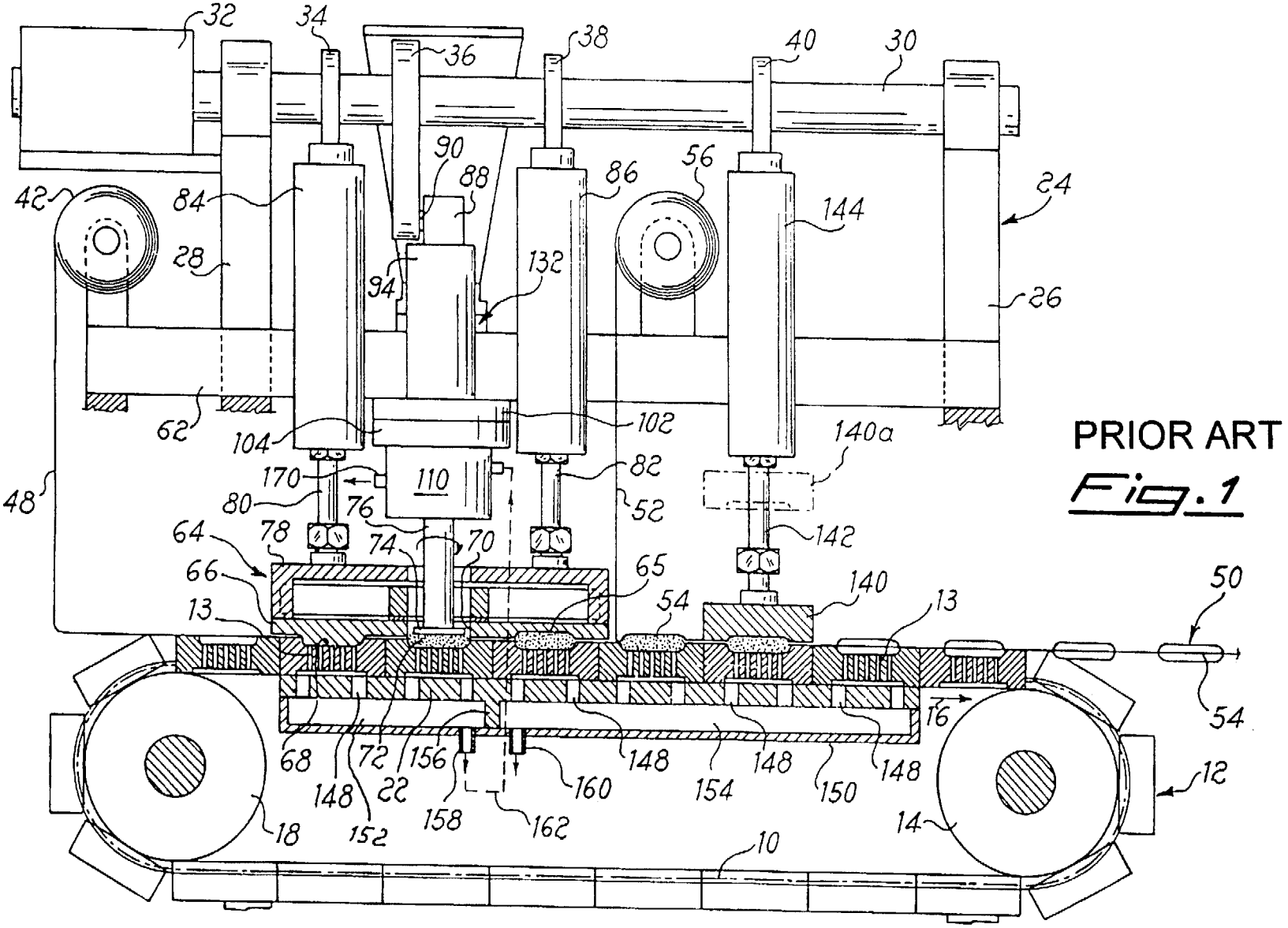
PRIOR ART Fig. 1
FIG. 1 corresponds to FIG. 1 of European Patent No. 0,225,494, which has been included in this description for the sake of reference to the general apparatus, the present invention being intended to be an improvement of the latter.

Therefore, the apparatus, to which the present invention relates, comprises a conveying chain 10, the links of which are formed by cup-shaped devices 12. The conveying chain is moved by a drive roller 14 in the direction of the arrow 16 and forms a closed loop around a transmission roller 18. The operating path of the chain 10 extends over a support surface 22. The conveying frame 10 has mounted above it a frame 24 with two shoulders 26 and 28 which rotatably support a cam shaft 30 operated by a reducer gearing 32 and carrying a plurality of cams 34, 36, 38 and 40 which are synchronized with one another in relation to operation of the different members and devices which are controlled by the said cams.

The reference number 42 denotes a reel of strip-type filter paper 48 intended to form the bottom supporting strip of the series of bags or tablets generally denoted by the reference number 50 at the exit end of the apparatus. Each bag or tablet 50 consists of said bottom strip 48, a top closing strip of filter paper 52 and a compressed measure of fresh coffee powder 54 accommodated in the cavity formed between the two strips.

The strip of filter paper 52 is taken from a reel 56 and guided so as to be deposited on top of the bottom strip 48 and the compressed measures of coffee powder 54 already arranged on the bottom strip.

The cross-member 62 of the frame 24 has mounted on it in the following order:

a unitary die 64 having the functions indicated below; and a forming and heat-sealing member 140 having the function of shaping the top strip of filter paper 52 on the bottom strip 48 and on the compressed measures of coffee powder 54 present thereon.

Returning to the unitary die 64, its purpose is to preshape and fill with a measured amount of coffee powder the bottom strip of filter paper 52 and for this purpose it has a base plate or sole 66 for ensuring adherence of the bottom strip 48 to the preformed cavity in each cup-shaped device 12, so that the paper is correspondingly shaped and kept in this configuration by the suction action applied via the through-holes 13 which are connected to a vacuum source (via the ducts 148, the compartment 152 and the duct 158).

The supply of the measured amount of coffee powder 72 inside the cavity formed in the bottom strip 48 of filter paper is performed via the hole 70, in the manner explained below, followed by operation of the ram or press-piece 74 which has its bottom operative end shaped in the manner of an upturned cup, matching the shape of the cavity formed in the filter paper 48. During supplying of the measured amount of coffee powder 72 and the subsequent pressing operation the action of the vacuum is eliminated, whereas this action is resumed when the cup-shaped device passes into the position located immediately downstream, but still underneath the die 64, opposite an immediately overlying concavity 65, so as to remove (and if necessary recycle) any coffee powder which could prevent mating with the top strip of filter paper and subsequent heat-sealing.

At last, after the top strip 52 has been deposited, the heat-sealing device 140 performs mutual heat-sealing of the matching filter-paper edges of the two strips 48 and 52 all around the compressed measure of coffee powder.

Figure 2:
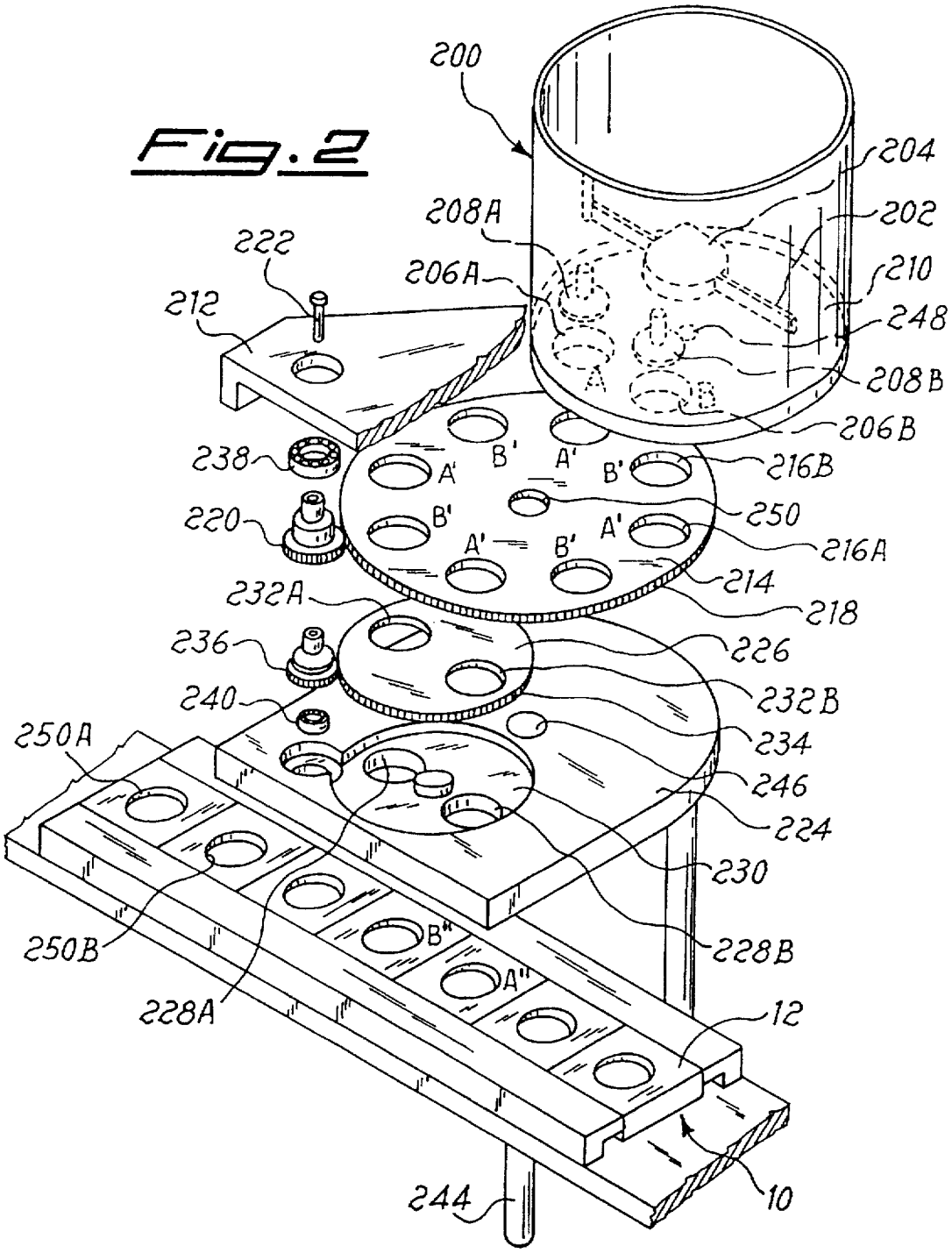
FIG. 2 is an exploded view of the device for supplying and metering coffee powder.
Figure 3:
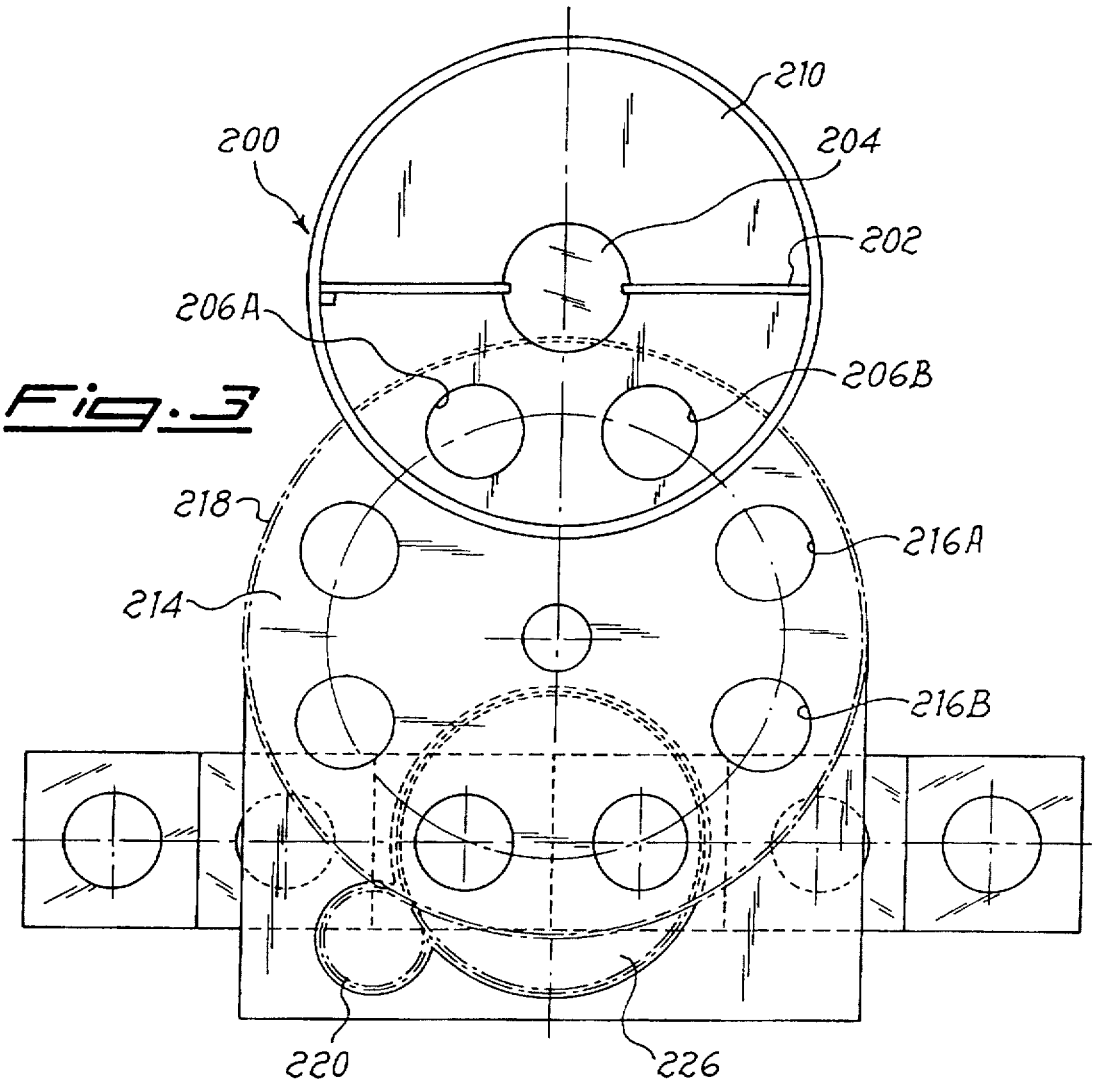
FIG. 3 is a top plan view of the device according to FIG. 2.
Figure 4:
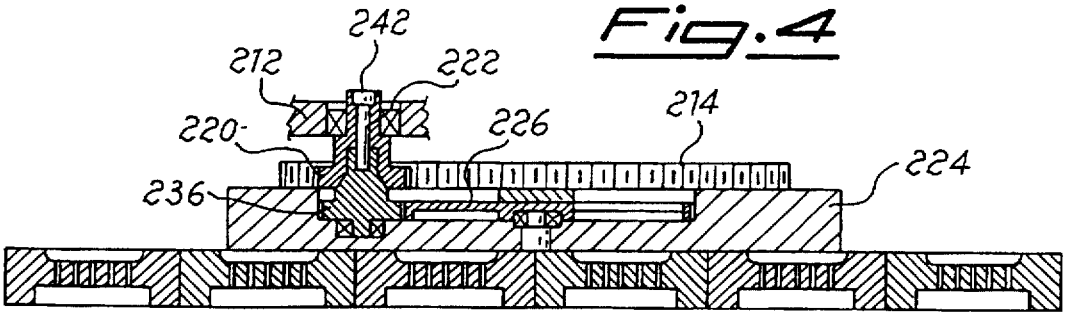
FIG. 4 is a partial sectioned view of the supplying and metering device.

With reference now to FIGS. 2, 3 and 4, a detailed illustration is provided of the device for supplying and metering the freshly ground coffee powder which cooperates with the hole 70 of the die 64 and which, forming the specific subject of the present invention, replaces that specifically provided in the apparatus described and claimed in European Patent No. 0,225,494.

This supplying and metering device comprises a storage and metering container which is generally denoted by the reference number 200 and fixed to a part of the immobile frame of the apparatus, such as for example to a bracket 212 rigidly connected to the cross-member 62. The container 200 has a generally cylindrical shape and freshly ground coffee powder is supplied into it, for example from a milling unit (not shown), the distribution of said coffee powder over the entire bottom surface being ensured by a blade-type leveller 202, extending radially from a hub 204.

The bottom 210 of the cylinder 200 has two holes 206 (A and B) which are spaced angularly at a predetermined angle and have cooperating with them respective expulsion press-pieces 208 (A and B) which can be operated between a raised position and a pressing and expulsion position via known means (not shown). It is worth noting that the thickness of the bottom 210 of the metering cylinder 200 is predetermined so that the cylindrical volume defined by each of the through-holes 206 (A and B) corresponds to the volume occupied by each predetermined measure of ground coffee powder.

The bottom 210 of the cylinder 200 has mounted underneath it the actual distribution and metering unit comprising an upper rotating disc 214 having formed in it a plurality of pairs of through-holes 216 (A and B), the centres of which are arranged on a concentric circumference with respect to the disc 214; the angular distance between the through-holes 216A and 216B of each pair is exactly the same as that existing between the holes 206 (A and B), with their diameters also being the same, so that rotation of the disc 214, the centre of which is conveniently offset with respect to that of the metering cylinder 200, brings in succession the pairs of holes 216 (A and B) into vertical alignment with the pair of holes (A and B) in the bottom of the cylinder 200.

The disc 214 has a peripheral crown 218 meshing with a pinion 220 mounted rotatably on a second pinion 236 by means of a pin 222; the mechanical group consisting of the two pinions 220 and 236, the respective bearings 238 and 240 and the pin 222 provided with a head 242 is in turn rotatably mounted between the bracket 212 and a fixed distribution plate 224.

The disc 214 has mounted underneath it a second rotatable closing disc 226, useful for opening and closing off communication between the pairs of holes 216 (A and B) of the disc 214 and additional through-holes 228 (A and B) formed in the fixed distribution plate 224 and more precisely in a cylindrical seat 230 formed in the thickness of the fixed plate 224.

The second rotating disc 226 has formed in it a pair of holes 232 (A and B) with a diameter and spacing which is the same as that of the pair of holes 216 (A and B) in the first rotating disc 214, so that during rotation of the two discs the holes 216 (A and B) are located in vertical alignment with the holes 232 (A and B). The rotating disc 226 is also made to rotate by means of meshing between the peripheral crown 234 on the disc itself and the aforementioned pinion 236. From FIGS. 2 and 4 it can be readily seen that the the pinion 236 is also housed in a corresponding seat formed in the thickness of the fixed plate 224, in a position so as to allow the aforementioned meshing.

A shaft 244 is provided for the rotational operation of the distribution disc 214, said shaft passing through the hole 246 formed in the fixed plate and terminating at the top through the hole 248 formed in the bottom 2 10 of the cylinder 200 so as to operate the hub 204. Obviously the shaft 244 also passes through a hole 250 formed in the disc 214 so that the disc itself is rigidly keyed onto the shaft 244. The through-holes 228 (A and B) formed in the seat 230 of the fixed plate 224 are aligned with the translation path of the link chain 12, in such a way that the aforementioned holes are aligned vertically with the cavities 250 (A and B) formed in the bottom strip of filter paper 48 following the action of the base plate or sole 66. Finally it must be pointed out that the shaft 244 is operated by a single electric motor (not shown) with an intermittent movement provided by a four-stage intermittent device; so that the distribution disc 214 is able to fill two holes 216 (A and B) each time it stops.

This is made possible by the fact that said filling operation is performed when these two holes are closed by the bottom plate of the fixed plate 224. The subsequent rotation, through 90 degrees, of the disc 214 brings the two filled holes still closed by the bottom part of the fixed disc into an intermediate position and subsequently further rotation of the same disc 214 brings the same two holes into the position for discharging into the cavities 250.

In this case, however, said discharging operation is not performed simultaneously for both holes, but first at the one situated further downstream with respect to the direction of forward movement of the chain 10 and then at the one situated further upstream. In this connection it should be pointed out that, precisely for this purpose, the closing disc 226, via transmission of the movement effected by means of the two gearings 220 and 236, performs a double rotation compared to the disc 214, so that one of the two openings 216A or 216B, depending on the circumstances, remains closed, while discharging of the other one into the corresponding cavity 250 is performed.

Moreover, the movement of the chain 10 is also controlled by a three-stage intermittent device, so as to cause forward movement of the chain itself by two cavities 250 between one stop and another.

From the above description it seems obvious that, with the present invention, the considerable advantages mentioned above are achieved, both as regards the increase in productivity of the apparatus and as regards structural simplification, from a mechanical point of view, of the device for supplying the measured quantity of freshly ground coffee powder.

It is understood that conceptually and mechanically equivalent variations and modifications are possible and foreseeable without departing from the scope of the present invention and that therefore these modifications may be contemplated within the scope of the invention itself For example, although the upper rotating disc 214 of the embodiment illustrated in FIGS. 2, 3 and 4 has four pairs of holes 216, nevertheless it is not limited to this number, it being possible to use in general **4*n* pairs of holes, where n is a whole number variable from 1 to a higher number, allowing, within the limits of constructional convenience, the presence of a number of pairs of holes 216**, which is a multiple of four.

Furthermore, the cups 12 to be filled on the chain 10 do not have to be necessarily adjacent to one another, but could be separated by a certain number of empty cups 12 to be filled during subsequent movements of the chain 10.

Moreover, nor is one limited to having a single metering container 200 and a single stopping disc 226 diametrically opposite to the metering container, but one could have for example two diametrically opposite metering containers which are alternately arranged between two stopping discs also diametrically opposite and arranged along a line perpendicular to that joining the two metering containers.

Obviously, with a metering disc of suitable dimensions, the number of metering containers may also be greater than two, as may be the number of stopping discs, the only condition to be satisfied being that the number of metering containers must be equal to the number of stopping discs.

It is pointed out for the sake of greater clarity that the chains 10 carrying the cups 12 form, with their axes, chords which intersect the circle of the distribution disc at two points, this being substantially the principle on which this invention is based.

I claim:

1. Apparatus for manufacturing bags of ground coffee-powder comprising:

one or more fixed metering containers having a bottom provided with a first pair of through-holes of a diameter corresponding to a volumetric quantity of coffee powder to be supplied onto a bottom strip or strips of paper so as to form a measure for a bag, a distribution disc, rotating intermittently and provided with a plurality of pairs of holes spaced angularly so that for each angular rotating movement a pair of holes of said plurality of pairs of holes is arranged in vertical alignment with said first pair of through-holes in the bottom of said metering container, one or more intermittently rotating closing discs, provided with a second pair of through-holes spaced so that in one of the positions assumed by the disc during its intermittent rotation said second pair of through-holes is aligned with one of said plurality of pairs of holes in said distribution disc, a fixed plate having a pair of holes in vertical alignment with said second pair of through-holes in said closing disc when said latter pair is aligned with one of said plurality of pairs of holes in said distribution disc and drive means including a single motor operating a single drive shaft for operating said distribution disc, gearing means for transmitting in a synchronized manner movement from said distribution disc to said closing disc, said drive shaft having rigidly connected thereto a first mechanical intermittent device for controlling intermittent angular movements of a corresponding distribution disc, and a second mechanical intermittent device being rigidly connected to a feed chain having cavities for receiving individual measures of ground coffee powder so that for each advancing movement of the feed chain two of said cavities are arranged in a position suitable for receiving simultaneously individual measures of coffee powder.

2. Apparatus according to claim 1, wherein said distribution disc is provided with 4n pairs of holes and its intermittent rotation occurs over angles of 90/n degrees.

3. Apparatus according to claim 2, wherein said distribution disc is provided with four pairs of holes and its intermittent rotation occurs over angles of 90 degrees.

4. Apparatus according to claim 1 wherein said distribution disc is provided with a perimetric crown meshing with a first pinion rigidly associated with a second pinion having its crown meshing with a perimetric crown formed on a peripheral edge of said closing disc, so that said closing disc performs a rotation of angular amplitude equivalent to 2n times each fraction of intermittent rotation of said distribution disc.

5. Apparatus according to claim 4, wherein said distribution disc is provided with a perimetric crown meshing with said first pinion rigidly associated with said second pinion having its crown meshing with a perimetric crown formed on the peripheral edge of said closing disc, so that said closing disc performs a rotation of double angular amplitude for each fraction of intermittent rotation of said distribution disc.

6. Aparatus according to claim 4, wherein said two pinions are rigidly connected to a freely rotating pin mounted between said fixed plate and a bracket supporting said metering container, said bracket forming part of the fixed frame of apparatus.

7. Apparatus according to claim 1, wherein said closing disc and said pinion meshing therewith are rotatably housed in a seat formed in the thickness of said fixed plate.

8. Apparatus according to claim 1, the metering containers are greater than 1 in number, as are the stopping discs, and in that the number of metering containers is equal to the number of stopping discs.

9. Apparatus according to claim 8, wherein the metering containers are two in number arranged diametrically opposite on the distribution disc and alternately between two stoppage discs also diametrically opposite and arranged along a line perpendicular to that joining the two metering discs.

10. Apparatus according to claim 9, wherein said closing discs and said pinions meshing therewith are rotatably housed in seats formed in the thickness of said fixed plate.

11. Apparatus according to claim 2, wherein said distribution disc is provided with four pairs of holes and its intermittent rotation occurs over angles of 90 degrees.

12. Apparatus according to claim 3, wherein said distribution disc is provided with a perimetric crown meshing with a first pinion rigidly associated with a second pinion having its crown meshing with a perimetric crown formed on the peripheral edge of said closing disc, so that said closing disc performs a rotation of angular amplitude equivalent to 2n times each fraction of intermittent rotation of said distribution disc.

13. Apparatus according to claim 10, wherein said distribution disc is provided with a perimetric crown meshing with said first pinion rigidly associated with said second pinion having its crown meshing with a perimetric crown formed on the peripheral edge of said closing disc, so that said closing disc performs a rotation of double angular amplitude for each fraction of intermittent rotation of said distribution disc.

14. Apparatus according to claim 5, wherein said two pinions are rigidly connected to a freely rotating pin mounted between said fixed plate and a bracket supporting said metering container, said bracket forming part of the fixed frame of the apparatus.

15. Apparatus according to claim 6, wherein said closing disc and said pinion meshing therewith are rotatably housed in a seat formed in the thickness of said fixed plate.

16. Apparatus according to claim 4, wherein said two pinions are rigidly connected to a freely rotating pin mounted between said fixed plate and a bracket forming part of the fixed frame of the apparatus supporting said metering container.

17. Apparatus according to claim 4, wherein the metering containers are greater than 1 in number, as are the stopping discs, and the number of metering containers is equal to the number of stopping discs.

18. Apparatus according to claim 7, wherein the metering containers are greater than 1 in number, as are the stopping discs, and the number of metering containers is equal to the number of stopping discs.

19. Apparatus according to claim 16, wherein the metering containers are greater than 1 in number, as are the stopping discs, and in that the number of metering containers is equal to the number of stopping discs.

20. Apparatus according to claim 3, wherein said closing disc and said pinion meshing therewith are rotatably housed in a seat formed in the thickness of said fixed plate.

* * * * *